United States Patent [19]

Kinder

[11] 4,400,832

[45] Aug. 30, 1983

[54] PANTY GARMENTS WITH REDIRECTED STRESS SUPPORT STRUCTURE

[76] Inventor: Carolyn Kinder, Star Rte., Box 44, Stuttgart, Ark. 72160

[21] Appl. No.: 214,655

[22] Filed: Dec. 9, 1980

[51] Int. Cl.[3] ..... A41B 9/04

[52] U.S. Cl. ..... 2/406; 2/409; 2/237; 128/100; 128/579 R

[58] Field of Search ..... 2/409, 406, 78 R, 78 A, 2/237, 221; 128/100, 579 R, 579 B

[56] References Cited

U.S. PATENT DOCUMENTS

| | | | |
|---|---|---|---|
| 943,366 | 12/1909 | McQuillen | 2/409 |
| 3,487,473 | 1/1970 | Janhsen | 2/409 X |
| 3,555,569 | 1/1971 | Jones | 2/237 X |
| 3,808,842 | 5/1974 | Fisher et al. | 2/409 X |
| 3,824,812 | 7/1974 | Matthews et al. | 2/409 X |
| 3,909,851 | 10/1975 | Garrou et al. | 2/409 |
| 4,091,466 | 5/1978 | Kearn | 2/409 X |

*Primary Examiner*—H. Hampton Hunter
*Attorney, Agent, or Firm*—Stephen D. Carver

[57] ABSTRACT

Garments, including panty garments and hose. Each garment includes support structure comprising twin, diagonally inclined halves forming stress vectors directed between the hips and pelvic region of the wearer. The panty garment may include lower leg portions separated by a lower crotch panel. The intermediate portions of the waistband halves ride over the iliac crest on opposite sides of the wearer, forming a first anchor point. Extreme ends of the support structure halves preferably converge at the front and rear of the crotch panel, passing over the abdomen and lower back regions, thus forming a second anchor point at the pelvic region.

5 Claims, 17 Drawing Figures

PANTY GARMENTS WITH REDIRECTED STRESS SUPPORT STRUCTURE

BACKGROUND OF THE INVENTION

This invention relates generally to panty garments. More particularly, the present invention relates to panty like garments such as panty hose, tights, leotards, girdles and other knitted or similar hosiery or garments.

In the prior art a variety of panty hose garments have been designed. As will be appreciated by those skilled in the art, panty hose includes a pair of elongated tubular leg portions which may be formed by conventional circular knitting techniques. The leg portions terminate in their lowermost regions in tapered feet. The uppermost terminal edges of the leg portions may be coupled through a variety of techniques to form a panty which covers the wearer's lower torso. In the prior art various forms of crotch panels have been suggested, and various forms of intermediate coupling panels or structure, including gussets, vertical divider panels, elastic members and the like are well known. Some prior art includes leg portions which terminate in angled sections adapted to be interwoven or coupled to intermediate body or crotch panels.

Representative prior art may be seen in U.S. Pat. Nos. 3,928,989; 3,109,301; 3,748,870; 3,956,909 and 2,962,884. Typically these references employ various forms of waistbands generally comprised of elastic members in the form of circular hoops which entirely surround the waist or abdomen of the wearer, lying in a plane perpendicular to the torso and above the navel of the wearer.

Such panty hose or knitted garments are generally produced upon conventional circular knitting machines which include a rotatable needle cylinder including a plurality of radially spaced-apart needles. Yarn fed to the needle during rotary knitting may be continued until various tubular legs of desired length are formed. When the proper length is reached, reciprocatory knitting may commence, whereupon various groups of needles in the cylinder may be moved to idle positions with the remainder of needles disposed an active position, depending upon the setting of conventional control mechanisms, which are well known in the art. Proper control setting may fashion proper terminal angled ends of the tubular leg portions of the panty hose, facilitating subsequent junctures with intermediate gussets or body panels. Such methods are thoroughly discussed in some of the above mentioned patents. Additionally, the structure of such machines is illustrated in U.S. Pat. Nos. 1,282,998, and 3,269,148. Additional knitting machine structure may be seen in Italian Pat. Nos. 572,609; 572,829, and 582,628. Additionally, British Pat. No. 1,027,327 and German Pat. No. 1,206,674 are representative. U.S. Pat. No. 3,987,650 is particularly germane, and U.S. Pat. No. 3,937,040 further illustrates the process for knitting panty hose upon circular knitting machines.

As mentioned previously, the upper waistband ultimately formed through a variety of prior art techniques is usually comprised of elastic material, and usually is of a hoop-like configuration, lying in a plane perpendicular to the lower torso of the wearer and located above the navel. The hoop stress of the elastic waistband, which in effect pinches the wearers waist provides enough force to hold the pantyhose upon the wearer. Partly because of ineffectual waistband design, it has been characteristic of prior art panty hose that it "works down" on the wearers figure, especially if the wearer is active. Accordingly the waistband must be tight enough to counteract this phenomena. However, as the day wears on, tightness of the waistband can become uncomfortable. Similarly, as the panty hose is worn, the crotch panel thereof eventually will lower, and this may cause certain uncomfortable feelings in some wearers, while being embarassing and annoying.

The latter effect is aggravated by the fact that conventional garment waistbands are not directly coupled to the lower crotch panel, but are linked thereto with deformable intermediate fabric. It is thus desirable to redesign the waistband structure employed in panty garments whereby to avoid such discomfort.

Waistband tightness in prior art devices also cause surface indentations of tissue. Such tightness and constriction coupled with the downward pull of the panty hose may collect the surface tissue of the wearers upper abdomen creating and accentuating any protrusion or bulge. Although prior art panty hose has been suggested to effectuate stomach figure control, such designs usually consist of extra elastic panels which substitute discomfort for limited figure control. Designs of the latter type suffer from the lack of suitable structural anchors linked to stationary body features.

Another problem with prior art pantyhose waistband designs is that some women prefer to tuck the lowermost portion of blouses, sweaters etc. into the waistband of panty hose under a skirt or slacks for a smoother look. Where the wearer must bend over or otherwise engage in physical activity, particularly reaching, the back of the waistband of the panty hose often becomes visible and unsightly, as it may be seen above the waistband of the outer garment.

It is therefore desirable to provide a panty garment waistband design, and/or a waistband design suitable for use with a variety of other similar garments, and/or garments characterized by such a waistband design, which avoids the previously discussed uncomfortable and undesirable characteristics. Such a waistband should be of low visibility, and should provide adequate support to the panty hose to prevent it from wearing down as the day progresses, while avoiding uncomfortable pinching or pressuring of the wearer. Ideally some portion of the waistband structure should be comfortably "anchored" to a portion of the body.

SUMMARY OF THE INVENTION

The present invention comprises various panty garments characterized by supportive structure which directs stress into two separate diagonal paths extending between the upper sides of the hip and the lower, inner edges of the thigh. Said "supportive structure" forms a part of a novel waistband means and may comprise separate elongated members of preferably elastic characteristics, or knitted regions of altered elasticity as would be contemplated in body hose. The "waistband" incorporated in the present invention redirects the stress otherwise generated by conventional designs into angled vectors. Tension from waistband means components circles the body in two separate diagonal paths, extending over each hip, crossing over the abdomen in front and the lower back in the rear, and passing under the body along sides of the crotch area, preferably at the sides of a separate crotch panel.

In those embodiments of the invention concerned primarily with panty garments or panty hose, the waistband means is preferably formed from a pair of semi-circular shaped, preferably elastic halves which include intermediate portions adapted to ride above the ilium crest of the bone structure at the upper sides or hips of the wearer, and are thus "anchored". The terminal ends of the waistband halves converge (and may intersect) at the front and rear of the wearer below the navel, preferably being anchored to the crotch panel. Conventional stress patterns are thus redirected. Resultant horizontal and vertical vector force components secure the garment to the wearer, while vertically supporting it to prevent it from "wearing down".

Where the aforementioned concept is incorporated into a body garment such as body hose, diagonal stress members may be widened or otherwise altered to integrally extend between the upper portions of the panty sections and the lowermost portions of the bra cups. Multiple, inclined and parallel courses could be used. In any case, the resultant vertical stress vector component will ultimately secure and thus "anchor" the bra cups to the crotch panel and, horizontal stress components will "flatten" the wearer's stomach area, avoiding "midriff bulge". All of the factors which tend to make prior art panty garment designs "wear down" also tend to make prior art bra cups (and bra backs) ride up, so that the vector stress solution presented herein remedies both problems. Such cosmetic benefits are of extreme importance with one piece bathing suits and leotards.

Thus the broad concept is embraced in a plurality of similar embodiments, and each is capable of being constructed with conventional rotary knitting techniques. It is to be understood that the present redirected stress system is adapted for use with a plurality of panty hose or panty garments. For example, the teachings of the present invention are ideally adapted for use with girdles, leotards, tights, support hose, control hose, panties, bathing suits, and the like. In the case of leotards, panty hose or similar legged garments, tubular leg portions may be coupled together to form a portion of the panty. The lower pelvic and rear pelvic and rear portions of the panty are preferably structurally coupled to terminal ends of the waistband halves, which converge downwardly.

Thus a broad object of the present invention is to provide a modified "waistband" design for panty garments such as panty hose, support hose, girdles, leotards, tights and the like which will avoid the previously mentioned disadvantages characteristic of conventional designs.

A basic object of the present invention is to provide a panty garment which takes advantage of the fact that in the human body, the pubic bone and hip bone are all one structure. By dividing the "waistband" system into two separate diagonally converging members, vector principles may be utilized to provide enhanced control and comfort by redirecting stress.

Another object of the present invention is to minimize or avoid the tendency of panty hose to "work down" on the figure of the wearer during physical activity. It is an important concept of the invention that anchor points on the human figure are utilized to direct stress patterns.

Another object of the present invention is to firmly secure the panty hose or panty garment to the wearer without generating unsightly regions of constricted and bulging flesh, or adding to the wearers discomfort.

A still further object of the present invention is to provide stress redirecting structure for panty garments, panty hose and the like which is extremely effective in controlling the stomach area of the wearer.

A related object is to provide stress redirecting structure for body garments which is effective for reducing midriff bulge.

A still further object of the present invention is to provide panty hose or a panty garment or the like characterized by a low visibility "waistband". To this effect downwardly converging waistband halves extend below the waist of exterior garments, and prevent inadvertant unfashionable exposure.

Another object of the present invention is to provide a redirected stress waistband design which may be readily incorporated into panty type garments such as swim suits, body shirts, leotards, tights, panty hose, girdles or the like.

Yet another object of the present invention is to provide a panty garment or panty-like garment equipped with stress redirecting structure of the character described which may be employed with or without gusset panels or with or without tubular extensions.

A more basic object of the present invention is to substitute a unique stress redirection system for conventional waistbands.

Another fundamental object is to provide a garment characterized by the previously discussed stress redirection features which may be readily manufactured by conventional techniques, i.e. with the use of conventional circular knitting machines.

These and other objects and advantages of the present invention, along with features of novelty appurtenant thereto, will appear or become apparent in the course of the following descriptive sections.

BRIEF DESCRIPTION OF THE DRAWINGS

In the appended drawings, which form a part of the specification and which are to be construed in conjunction therewith, and in which like reference numerals have been employed throughout to indicate like parts in the various views.

DETAILED DESCRIPTION OF THE DRAWINGS

Figure 1:
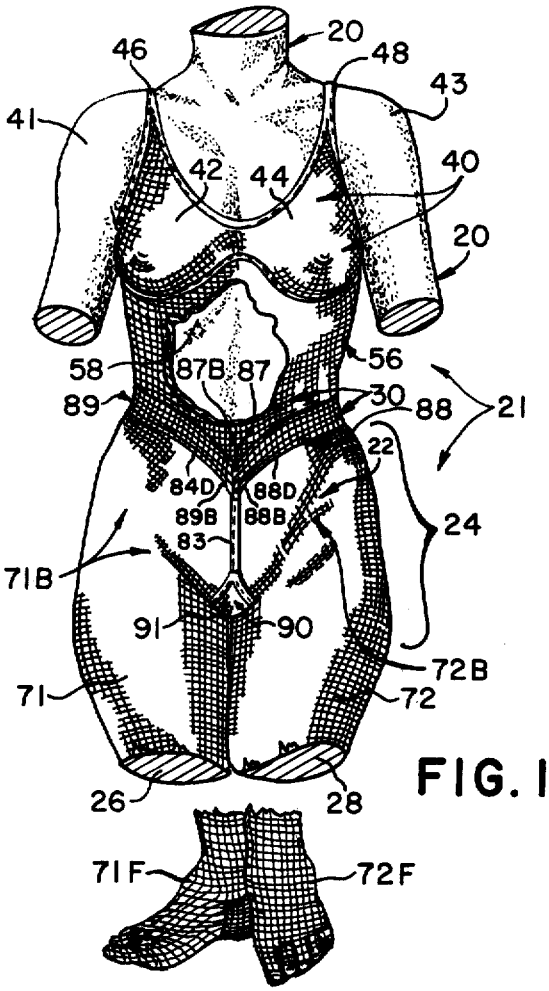
FIG. 1 is a pictorial view illustrating a body garment constructed in accordance with the teachings of this invention, the garment disposed upon a conventional mannequin, and with parts thereof broken away or shown in section for clarity.
Figure 2:
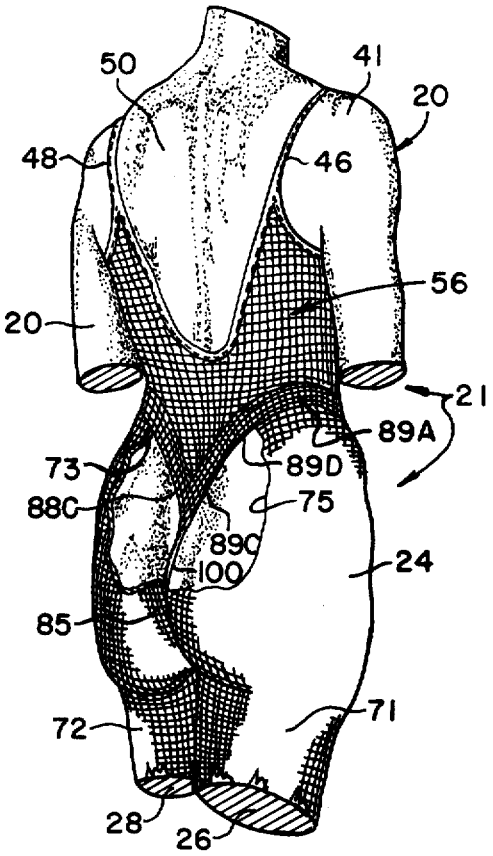
FIG. 2 is a view similar to FIG. 1, but taken from the rear of the mannequin.
Figure 3:
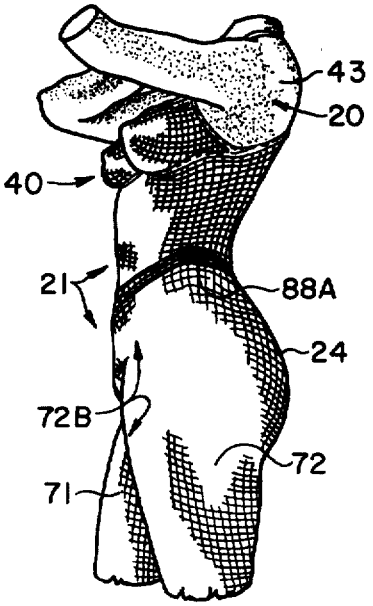
FIG. 3 is a pictorial side view.

With reference now to the appended drawings, FIGS. 1-3 illustrate body hose, leotard, or similar legged embodiments of the present invention. The latter embodiment includes the basic concept of the present invention, and illustrates its application in conjunction with a panty garment, a legged panty garment, and/or a one-piece leotard or body suit. A basic panty garment embodiment of the present invention is illustrated in FIGS. 6-9. An alternative embodiment of the concept is illustrated in FIGS. 10-13. FIGS. 14-17 illustrate another embodiment primarily concerned with figure support.

With attention directed now to FIGS. 1-3, a conventional mannequin 20 is illustrated for modeling the garment(s). It must be appreciated that, for purposes of subsequent discussion, the contours and features of the mannequin and those of the human form will be referred to with equivalency.

The panty hose or panty garment embodiment 21 of the present invention includes a panty portion 24 adapted to cover the lowermost torso 22 of the wearer. Garment 21 preferably includes integral, knitted tubular leg portions covering the legs 26, 28 of the wearer 20. A "waistband-replacing" stress means 30 redirects stress into proper vectors to support the garment upon the wearer. The stress system establishes "anchor points", and completely replaces conventional circular or hoop-like waistbands.

The basic "panty hose" embodiment of the present invention consists of the basic panty garment 24 combined with legs 71, 72. Bra means 40 may be optionally included, being "linked" to stress redirecting means 30 by intermediate midriff control region 56. Portions 40 and 56 may be employed with panty 24 without legs.

Bra 40 includes a pair of breast supportive cups 42,44 which may be supported upon opposite shoulders 41, 43 of the wearer by conventional straps 46, 48 which may downwardly converge at the back or rear 50 of the wearer. Intermediate midriff section 56 may be included to cover and/or control the stomach region 58. The midriff section may be employed with or without legs, and may be formed of a variety of materials. This region may be knitted with conventional circular knitting techniques, or as will be later described, for better midriff control it may be formed from a plurality of parallel, downwardly-angled courses of knitted material formed of elastic material or the like. The latter construction will be thoroughly discussed in conjunction with explanation of FIGS. 14-17.

Figure 4:
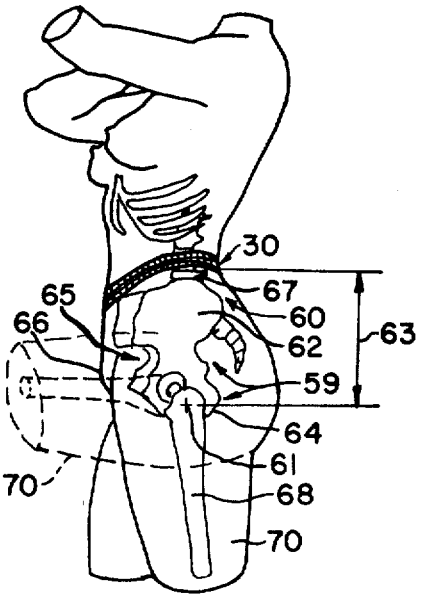
FIG. 4 is a pictorial view illustrating the bone structure of a female human.
Figure 5:
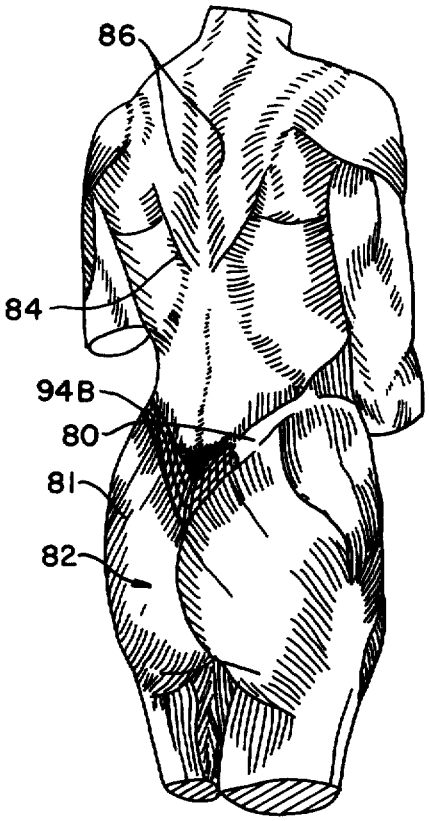
FIG. 5 is a pictorial view illustrating muscles in the human female, and illustrating a portion of the redirected stress support structure of the present invention.
Figure 6:
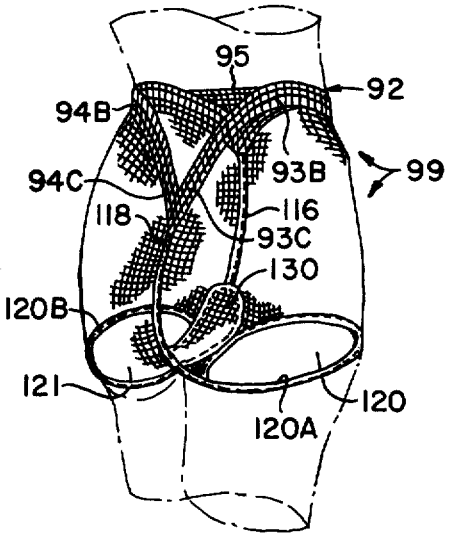
FIG. 6 is a pictorial view illustrating a panty garment constructed in accordance with the teachings of the present invention.

With attention now to FIGS. 4 and 5, basic muscle and bone structure of the wearer will be reviewed to appreciate the thrust of the present invention. To this effect, the hip bone 59 structure includes an intermediate ilium 62, lower ishchium portions 64, and a front pubic bone region 65. Femur 68 is coupled to ishchium 64 and defines an arc as leg 70 is moved to the position illustrated in dashed lines. It will be apparent from FIG. 4 that a constant distance 63 exists between the center of rotation 61 and the ilium crest 67 when movement occurs. While distance 63 is constant, the distance between the stomach area and points upon the wearers legs will change during leg movement. This factor contributes to the "wearing down" of conventional panty hose and similar garments when the wearer is active.

In the human female upper hip bone structure (particularly the crest of the ilium) is of larger width than the midriff region. With reference to FIG. 5, region 80 comprising the posterior superior iliac area is above the gluteus maximus muscles 82. Superior V-shaped profile is indicated at the lowermost portion 84 of the trapezius muscles 86, above the lower back muscles, the latissimus dorsi. Importantly, the stress redirecting members employed herein, which will replace waistbands characteristic or prior art panty hose or panty hose garments, are adapted to contact the regions above the wearers hips above the iliac crest, converging diagonally downwardly over the upper abdomen at the front of the wearer. At the rear of the wearer the rear ends of the stress redirecting members can substantially align with the posterior superior iliac spine area.

With reference again now to FIGS. 1-3, it will be appreciated that the invention is essentially symmetrical. Opposite sides will be mirror images of one another, matching the structural symmetry of the human body. Intermediate panty portion 24 may be integral with a pair of spaced-apart, elongated tubular leg portions 71, 72 preferably formed of conventional knitted materials, which cover wearer legs 26, 28 respectively. These leg portions are conventional, and, as will be appreciated by those skilled in the art, may terminate at their lowermost region in feet portions such as feet 71F, 72F. The uppermost edges of regions 71B, 72B (FIGS. 1, 3) of the tubular legs 71, 72 are adapted to be coupled together through well known techniques forming panty portion 24. During manufacture the conventional circular knitting machine operation may be programmed by removing various needles from the sewing cycle to produce angled, symmetrical cuts in opposite leg portions to facilitate subsequent joining. When the leg portions are then sewn together, the lowermost intermediate panty portion will be formed. The uppermost preferably selvaged end portions will terminate in an integral stress redirecting system 30 which replaces conventional waistbands. Essentially, the stress redirecting means will ride over the iliac crest at the sides of the wearer, laying over the rectus abdominus muscles at the front of the wearer.

The stress redirecting means includes first and second elongated members 88, 89, which include intermediate portions 88A, 89A respectively which are adapted to anchor the garment at the iliac crest of the wearer. The extreme front ends 88B, 89B converge diagonally downwardly towards the lower front of the wearer, terminating at apex 87 on or below the navel 87B, and are structurally linked to the crotch or pubic region of the wearer as by seam 83; or ends 88B, 89B may converge at the front 91 of crotch panel 90, depending upon the size and configuration of the crotch panel. The stress redirecting means 30 is thus additionally linked or "anchored" beneath the pelvis.

Crotch panel 90 is preferably formed of cotton and, except for being structurally linked to the stress redirecting means of the present invention, may be of conventional construction. In a preferred form of the invention the rear ends 88C, 89C, of the stress redirecting members (FIG. 2) are aligned with the posterior superior iliac spine area 80 (FIG. 5) above the gluteus medius muscles 81. The ends may terminate in seam 100 coupled to the pelvic region of the wearer at the rear end of crotch panel 90. However, the invention will function, albeit less efficiently, if only the front ends 88B, 89B of the stress redirecting members are angled toward and anchored to the crotch region as previously discussed. The lowermost edges 88D, 89D of the elongated stress redirecting members 88, 89 respectively terminate in the uppermost lateral edge portions 73, 75 of the lower leg portions (or panty portion). The stress redirecting members may be formed from welts, knitted from material of enhanced strength and/or elasticity, or may be otherwise formed through conventional techniques. Preferably the stress redirecting portions of the garment will be integrally knit with the lower tubular leg portions. Front wall 83, which links the stress redirecting members with the crotch panel, will be sewn when the tubular leg portions are secured together to form the garment. As will later be described, alternative linkage structure may be employed in substitution for seam 83.

Through this system two anchor points will be formed. One anchor point results above the iliac crest (at each side of the wearer) and a second anchor point is determined at the bottom of the pelvis. Garment support is effectuated by tension directed along diagonal stress vectors between the iliac crest regions (or the top of the pelvic bone) and, the lower ishchium 64 (or the bottom of the pelvic bone). The diagonal stress vectors resolve into horizontal and vertical components. Horizontal stress components tension the garment about the sides of the wearer and over the upper abdomen. Among other things, the vertical stress component(s) secure the crotch and leg portions and effectuate wearer figure control and shaping about the gluteus maximus and/or midriff regions. Upper body shaping may be facilitated by similar control means of increased tension under the bra cup area. Seaming and piecing may be employed, or, alternatively increased elasticity regions can be knitted into the garment.

FIGS. 6–9 further illustrate a basic panty garment embodiment of the present invention, generally designated by the reference numeral 99. It will be apprecitated that the panty garment 99 of FIGS. 6–9 may be associated with hose portions or other options. Embodiment 99 is thus similar to panty portion 24 of the previously discussed embodiment.

Figure 7:
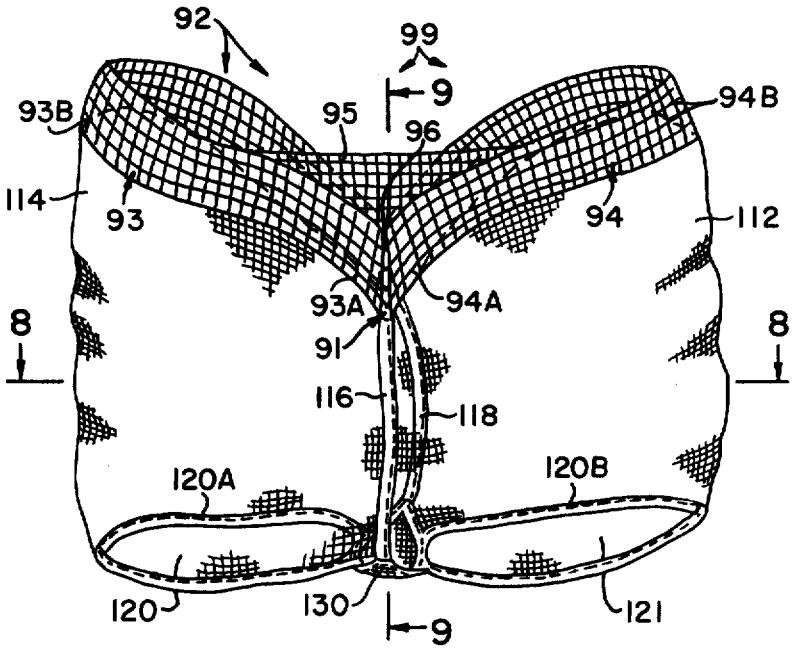
FIG. 7 is an enlarged frontal pictorial view of a panty garment constructed in accordance with the teachings of the present invention, with portions thereof broken away or shown in section for clarity.
Figure 8:
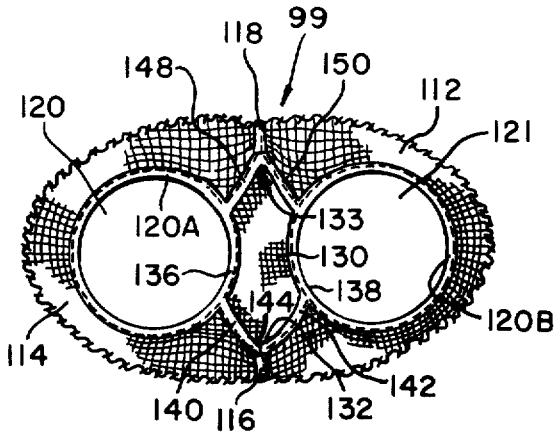
FIG. 8 is a sectional view taken generally through lines 8—8 of FIG. 7.
Figure 9:
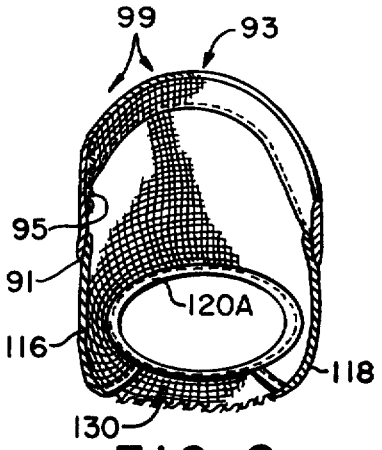
FIG. 9 is a side sectional view taken generally along line 9—9 of FIG. 7.

Garment 99 is also of symmetrical characteristics, the portions on opposite sides of section line 9—9 (FIG. 7) being mirror images of one another. Opposite panty portions 112, 114 are thus coupled together through conventional wales 116, 118, and the panty garment forms conventional leg holes 120, 121 (FIG. 8). The leg holes are circled by preferably selvaged edges 120A, 120B which may be separately formed from elastic materials or the like, or they may be left flared. An intermediate preferably cotton crotch panel 130 is sewn into the garment between the leg holes. As best viewed in FIG. 8 the crotch panel 130 includes a front portion 132 and a rear portion 133, a left (as viewed in FIG. 7) side 138 and a right side 136. In this embodiment a front, right crotch panel seam 140 is opposite front, left seam 142, forming a juncture at 144 coupled to an elongated vertical wale 116 (FIG. 7). Similarly, left rear crotch panel seam 150 meets right rear seam 148, forming a juncture structurally coupled to vertical rear seam 118.

Stress redirection system 92 is similar to system 30 previously described. A pair of similar, mirror image elongated stress members 93, 94 replace the conventional waistband. Each member includes front end portions 93A, 94A which terminate at the front of the wearer at apex 91. Apex 91 is linked to the crotch panel 130 to provide a pelvic anchor in the pelvic or crotch region. The intermediate portions 93B, 94B of the elongated stress redirecting members 93, 94 are adapted to ride above the hips of the wearer above the iliac crest to provide an upper anchor point. The rear ends 93C, 94C (FIG. 6) of the stress redirecting members terminate upon the rear of the wearer, and are coupled to wale 118 which is sewn to the crotch panel. Thus the extreme ends of the stress redirection members are "anchored" under the pelvic region. It will thus be apparent that the stress redirecting means 92 forms anchor points above the iliac crest and under the pelvic regions of the wearer, and substantially diagonal stress vectors are thus determined between the anchor points.

An optional knitted gusset 95 extends at the front of the wearer between members 93, 94 to provide additional stomach control and a smooth (non indented) edge to the top of the garment at the front of the waist. It will be appreciated that with the present embodiments the downwardly converging stress redirecting members will normally intersect on or below the navel of the wearer. For example, with reference to FIG. 1, it will be apparent that the downwardly converging apex 87 of stress redirecting means 30 will normally be positioned on or below the navel 87B of the wearer. It should also be understood that to structurally effectuate the teachings of the invention the stress members need not intersect, as along as stress is distributed between appropriate anchor points determined above the iliac crest and below the pelvic regions. Moreover, the stress members may terminate directly at the crotch panel, or may be coupled thereto by alternative structure.

Figure 10:
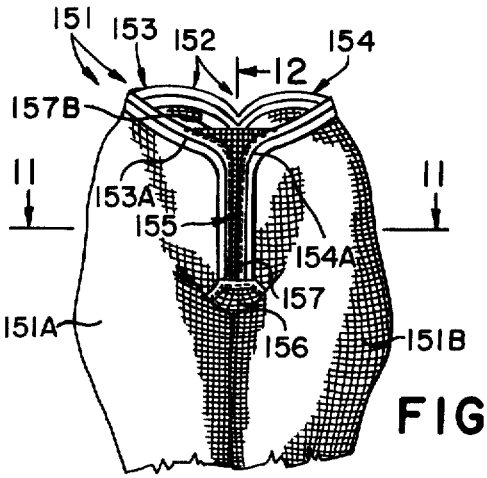
FIG. 10 is a pictorial view of an alternative embodiment of the present invention, with parts thereof broken away for brevity.
Figure 14:
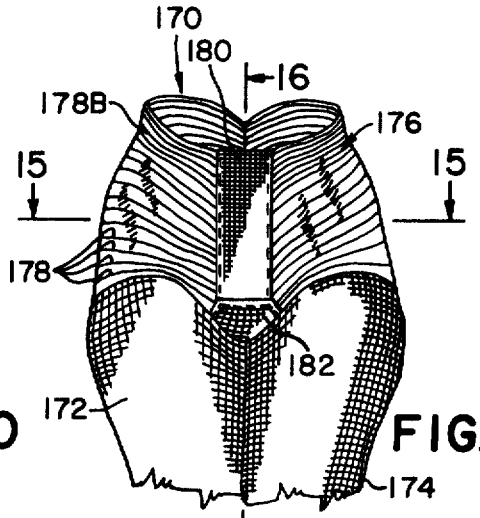
FIG. 14 is a pictorial view of an alternative embodiment of the present invention.
Figure 13:
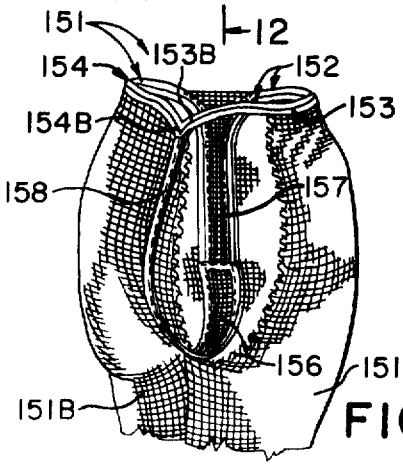
FIG. 13 is a pictorial view of the rear of the garment illustrated in FIG. 10, with parts broken away or shown in section for clarity.
Figure 17:
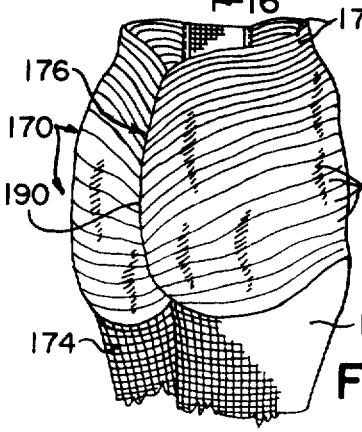
Figure 11:
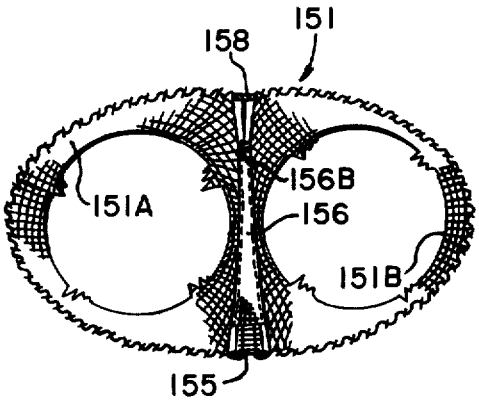
FIG. 11 is an enlarged sectional view taken generally along line 11—11 of FIG. 10.
Figure 12:
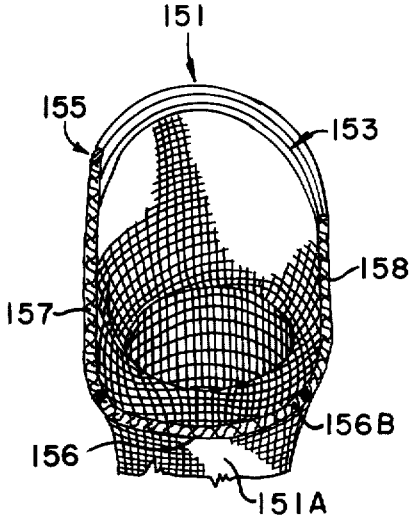
FIG. 12 is an enlarged side sectional view taken generally along line 12—12 of FIG. 10.

With reference now to FIGS. 10–12, an alternative embodiment generally designated by the reference numeral 151, includes a redirected stress support system 152 similar to previously discussed systems 30, 92. System 152 also provides anchor points above the iliac crest and below the pelvic regions of the wearer. Embodiment 151 may be employed in conjunction with optional upper bra and midriff sections, and/or lower leg sections 151A, 151B. Stress system 152 includes a pair of stress redirecting members 153, 154 which are adapted to ride above the iliac crest of the wearer and extend downwardly to the pelvic region. However, as illustrated in FIG. 10, the frontal end portions 153A, 154A of the stress redirecting members terminate in a broad, vertically oriented support panel, generally indicated by the reference numeral 155. Panel 155 extends downwardly to a conventional crotch panel 156. Panel 156 (which may be similar to panels 90 or 130 previously discussed) extends beneath the crotch of the wearer, between opposite legs 151A, 151B. Panel 155 is formed from a central gusset 157 which includes top 157B which provides front waist smoothness without indentation. The forward ends 153A, 154A of stress members 153, 154 converge at gusset 157, and are thus anchored to the pelvic region. The rear ends 153B, 154B (FIG. 13) of the stress members terminate at a rear wale 158, extending vertically downwardly to the rear of lower crotch panel 156.

Figure 15:
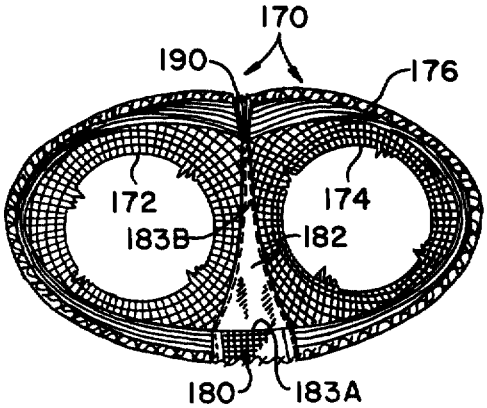
FIG. 15 is an enlarged, sectional view and taken generally along line 15—15 in FIG. 14.
Figure 16:
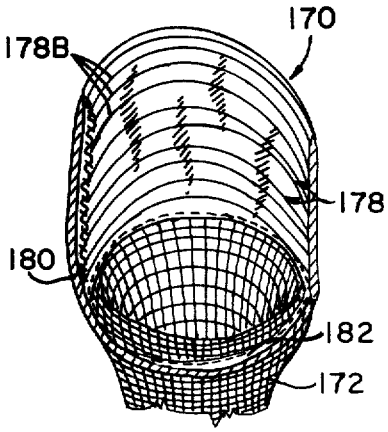
FIG. 16 is an enlarged sectional view taken generally along line 16—16 of FIG. 14; and, FIG. 17 is a rear pictorial view of the alternative embodiment of the present invention first illustrated in FIG. 14.

With reference now to FIGS. 14–17, an alternative support garment embodiment generally designated by the reference numeral 170 is illustrated. Garment 170 may include lower leg portions 172, 174 and may include intermediate midriff sections, bra and/or other breast support structure. Essentially, the panty portion 176 is comprised a plurality of parallel, spaced-apart downwardly converging courses 178, all of which include parallel members extending diagonally downwardly upon the front and rear of the wearer. Preferably, each of the front courses terminate in a central panel 180 which vertically extends to crotch panel 182. A rear wale 190 (FIG. 17) interconnects the rearward downwardly converging course portions, and connects to the rear of the crotch panel 182 (FIG. 15). Crotch panel 182 is generally triangular, comprising a front 183A which rearwardly tapers to an apex 183B coupled to wale 190. Of course, a variety of suitable alternative crotch panel configurations would be acceptable.

It will be apparent that the stress redirecting system employed by garment 170 results from combined effects of a plurality of angled stress vectors. In fact, it will be apparent the the uppermost courses 178B function identically with the stress redirecting means previously discussed. In other words, embodiment 170 also includes stress redirecting members anchoring the garment between the iliac crest and the pubic regions. However, the intermediate regions of the panty are further strengthened by a plurality of parallel, similarly angled courses which amplify the effects previously discussed. Suitable component materials include typical elastic yarns and the like. Alternate courses may be varied in relative elasticity, whereby to shape the wearer in a desired fashion.

It is contemplated that the various portions of the present invention may be comprised of stretch yarn including well known synthetic, thermal plastic or heat settable yarns, including Agilon, "Cantrece" 880 or 881, false twist S and Z yarns of the type disclosed in U.S. Pat. No. 2,771,733, and Duotwist yarn of the type disclosed in U.S. Pat. No. 3,091,908.

In manufacture it is contemplated that a conventional rotary knitting machine may be employed. Conventional circular knitting of tubular leg portions of the various embodiments may be continued until the uppermost terminal ends which may be sewn together as desired to form the panty are provided. At this point, as will be appreciated by those skilled in the art, reciprocal knitting may commence, and various arcs or regions of needles are added or withdrawn from the pattern to form proper contoured terminal edges. With a progressive decrease of the needles in the knitting arc, and by other typical adjustments to the cams and controls of the circular knitting machine, the upper terminal regions of the panty and leg portions may be formed as desired, and "tightness" may be varied as desired. By the substitution of elastic yarns and/or welting the stress redirecting portions of the garment may be integrally formed. In particular, it must be appreciated that regions of enhanced elasticity, which for example, may separate the panty from the midriff sections, may form the stress redirecting members necessary to provide the previously discussed anchor points. It is contemplated that various yarns of relatively increased elastic strength may be used, as may double knitting techniques. The circular knitting technique is well known, and it may be seen in many of the previously cited patent references. However, particular attention is directed to manufacturing techniques described in U.S. Pat. Nos. 2,962,884; 3,956,909; 3,987,650, which are hereby incorporated by reference.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A garment such as panty hose, tights, leotards or the like, the garment comprising:

a panty portion;

a pair of left and right elongated, tubular leg portions coupled to said panty portion; and, stress redirecting means for supporting said panty and leg portions and comprised of first left, and second right elongated waistband members which, when said garment is worn are stressed and anchored upon the wearer's hips above the crest of the wearer's ilium and which downwardly converge at the front of the wearer toward the lowermost pelvic region of the wearer, said first left elongated waistband member structurally coupled to said left tubular leg portion to form a redirected stress pattern extending diagonally across the left hip between the top of the wearer's left ilium crest and the pubic area of the left upper inner thigh, said second right elongated waistband member structurally coupled to said right tubular leg portion to form a redirected stress pattern extending diagonally across the right hip between the top of the wearer's right ilium crest and the pubic area of the wearer's right upper inner thigh.

2. The combination as defined in claim 1 wherein said panty portion includes a crotch panel coupled between adjacently disposed, spaced-apart lowermost segment of the upper terminal region of said left and right leg portions, the crotch panel structurally coupled at the front and rear of the wearer to the extreme ends of the supportive stress redirecting members.

3. The combination as defined in claim 2 wherein said crotch panel is of substantially elongated dimensions including a front end and a rear end and at least two sides, and said stress redirecting members extend from front sides of said crotch panel front diagonally across the stomach area toward and over a region upon the hips over the ilium crest, and then diagonally converge down the lower back of the wearer substantially upon the posterior superior illiac spine and are terminally coupled to the rear of said crotch panel at opposite sides of the wearer.

4. A panty garment comprising:

a body portion for covering the lower torso of the wearer, the body portion having left and right leg holes and, stress redirecting means for supporting said panty portion comprised of first left and second right elongated members anchored upon the wearer's hips above the crest of the illium and downwardly converging to an anchor point near the lowermost pelvic region of the wearer, said first left elongated waistband member structurally terminating adjacent said left leg hole to form a redirected stress pattern extending diagonally across the left hip between the top of the wearer's left ilium crest and the pubic area of the left upper inner thigh, said second right elongated waistband member structurally terminating adjacent said right leg hole to form a redirected stress pattern extending diagonally across the right hip between the top of the wearer's right ilium crest and the pubic area of the wearer's right upper inner thigh.

5. The combination as defined in claim 4 including a lower crotch panel disposed between adjacent leg holes of said body portion, the crotch panel structurally coupled at its front to extreme ends of said stress redirecting elongated members, wherein said crotch panel is of substantially elongated dimensions including a rear end and at least two sides, and said stress redirecting members extending from front sides of said crotch panel front diagonally across the stomach area toward and over a region upon the hip over the ilium crest, and then diagonally converge down the lower back of the wearer substantially upon the posterior superior iliac spine and are terminally coupled to the rear of said crotch panel.

* * * * *